United States Patent [19]

Tani et al.

[11] Patent Number: 4,911,262

[45] Date of Patent: Mar. 27, 1990

[54] MUFFLER

[75] Inventors: Katsushige Tani, Chiba; Toyoki Kawashima, Fujisawa, both of Japan

[73] Assignee: Nihon Radiator Co., Ltd., Tokio, Japan

[21] Appl. No.: 121,942

[22] Filed: Nov. 19, 1987

[30] Foreign Application Priority Data

Nov. 21, 1986 [JP] Japan ..... 61-278444

[51] Int. Cl.[4] ..... F01N 1/08

[52] U.S. Cl. ..... 181/266; 181/272

[58] Field of Search ..... 181/265, 266, 272

[56] References Cited

U.S. PATENT DOCUMENTS

| | | | |
|---|---|---|---|
| 2,109,220 | 2/1938 | Noblitt et al. | 181/266 |
| 2,618,354 | 11/1952 | Hedrick | 181/266 |
| 3,583,524 | 6/1971 | Dubois | 181/266 |
| 4,177,875 | 12/1979 | Kurobe et al. | 181/266 X |
| 4,192,401 | 3/1980 | Deaver et al. | 181/266 |
| 4,192,403 | 3/1980 | Nakagawa et al. | 181/272 X |
| 4,393,956 | 7/1983 | Tsukui et al. | 181/265 |

*Primary Examiner*—B. R. Fuller

*Attorney, Agent, or Firm*—Horst M. Kasper

[57] ABSTRACT

A muffler includes a first expansion chamber, a second expansion chamber, a resonator chamber and an inlet pipe having a first open end and a second open end. The first open end of the inlet pipe is inserted into the first expansion chamber so as to communicate with the first expansion chamber. A resonator pipe runs substantially in coaxial relationship with the inlet pipe so as to establish communication between the first expansion chamber and the resonant chamber. A return pipe is disposed between the resonator chamber and the second expansion chamber and passes through the first expansion chamber for establishing communication between the first expansion chamber and the second expansion chamber. An outlet pipe communicates with the second expansion chamber. Said return pipe is inserted with the open end into said resonator chamber, while the inserted open end of the return pipe is furnished with a plug. A portion of the return pipe passes through the first expansion chamber. The return pipe passing through the resonator chamber is provided with at least a throughhole.

5 Claims, 3 Drawing Sheets

MUFFLER

DETAILED DESCRIPTION OF THE INVENTION

The present invention relates to a muffler for use with an automobile.

As a muffler for automobile use, there is known the type as disclosed in Japanese Laid-open Utility Model Publication No. 57-13816.

FIG. 6 shows this type of muffler wherein reference numetral 11 designates a body of the muffler sealed with end plates 13 and 15.

The interior of the muffler 11 is divided into three parts by partition plates 17 and 19 thereby forming a first expansion chamber 21, a second expansion chamber 22 and a resonator chamber 23.

An inlet pipe 25 passes through the end plates 13 and 17 and opens in the first expansion chamber 21 and a resonator pipe 27 is arranged coaxially with the inlet pipe 25.

Passing through the partition plate 17 there is arranged a return pipe 29 and through the partition plates 17 and 19 and the end plate 15, there is arranged an outlet pipe 31.

In the case of the muffler of the above structure, exhaust gases introduced into the body 11 through the inlet pipe 25 are subjected to muffling actions in the first expansion chamber 21 and the second expansion chamber 22 due to expansion and to a muffling action in the resonator chamber due to resonance.

Further, the resonator chamber 23 of the muffler is formed with the resonator pipe 27 passing through the partition plate 19 but since the central frequency of noises subjected to a muffling action is determined by the length and diameter of the resonator pipe 27, there has conventionally arisen a problem that only one kind of noise frequency, for example, the noise frequency in the low-speed operation zone of the engine can be muffled.

Accordingly, the main object of the present invention is to provide a muffler which is capable of eliminating noises generating throughout the entire operation of the engine in both high- and low-speed operation zones thereby sharply improving the muffling efficiency thereof over the conventional muffler.

EMBODIMENTS OF THE INVENTION

Preferred embodiments of the present invention will now be described in detail with reference to the accompanying drawings.

Figure 1:
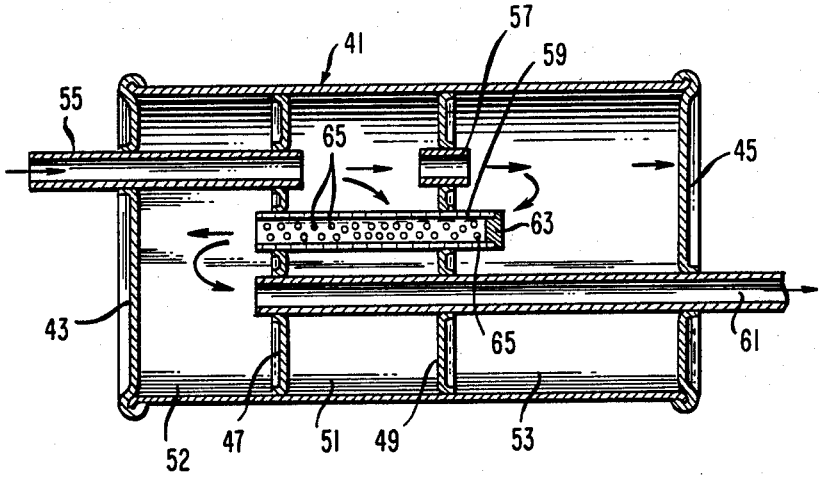
FIG. 1 is a vertical sectional view of one embodiment (as a first invention) of a muffler according to the present invention.

FIG. 1 shows one embodiment (as a first invention) of a muffler according to the present invention wherein reference numeral 41 designates a body of the muffler sealed with end plates 43 and 45.

The body 41 is divided into three parts by partition plates 47 and 49 thereby forming a first expansion chamber 51, a second expansion chamber 52 and a resonator chamber 53.

Passing through the end plate 43 and the partition plate 47, there is provided an inlet pipe 55 which opens in the first expansion chamber 51 and a resonator pipe 57 is arranged coaxially with this inlet pipe 5.

Further, passing through the partition plates 47 and 49, there is provided a return pipe 59 and through the partition plates 47 and 49 and the end plate 45, there is provided an outlet pipe 61.

In the instant embodiment, the return pipe 59 is inserted into the resonator chamber 53 with the inserted end opening being sealed with a plug 63.

The portion of the return pipe 59 passing through the first expansion chamber 51 and the resonator chamber 53 is provided with a number of small holes 65.

In the case of the muffler of the above structure, exhaust gases introduced into the muffler body 41 from the inlet pipe 55 are subjected to muffling actions in the first and second expansion chambers 51 and 52 due to expansion and to a further muffling action in the resonator chamber 53 due to resonance.

Figure 2:
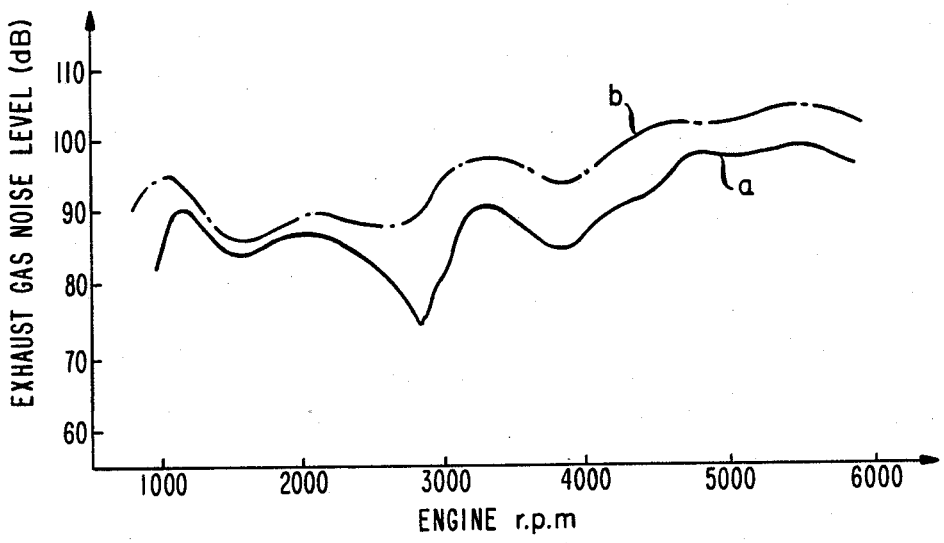
FIGS. 2 and 3 are graphs showing muffling characteristics of the muffler shown in FIG. 1.
Figure 3:
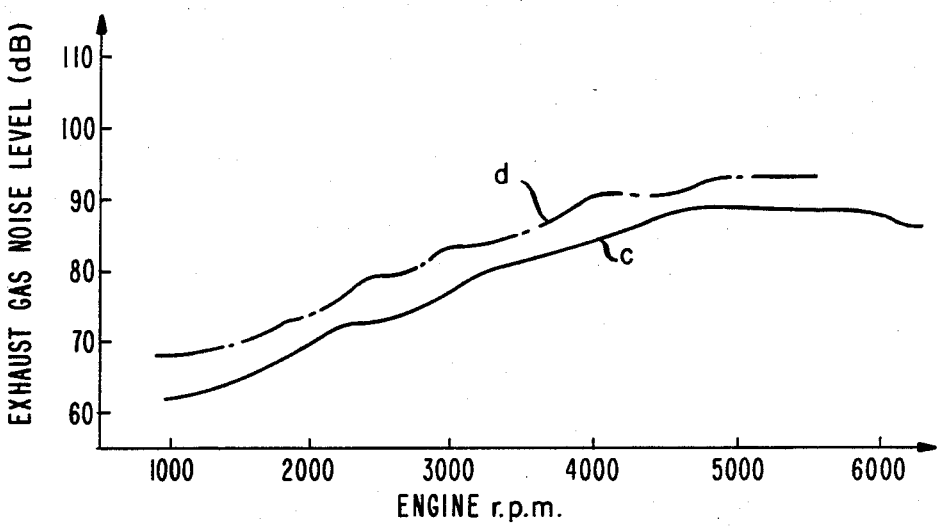

Thus, as shown in FIGS. 2 and 3, the muffler of the above structure makes it possible to sharply improve its muffling efficiency over the conventional muffler throughout the entire operation of the engine in both high- and low-speed zones.

Figure 6:
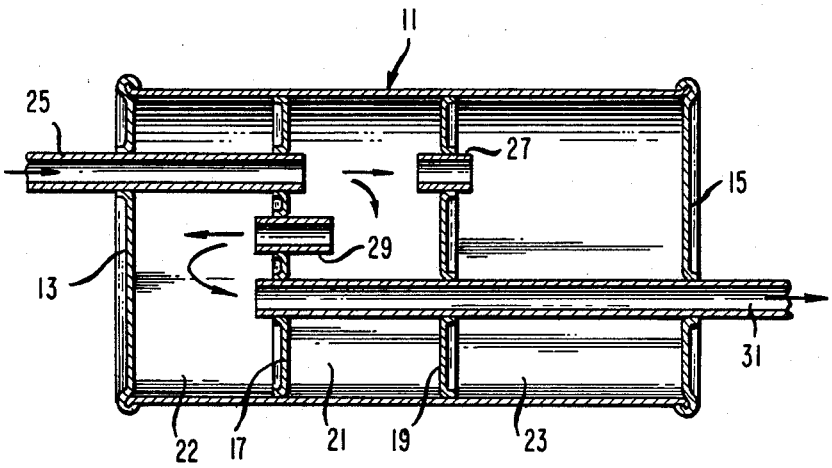
FIG. 6 (PRIOR ART)
FIG. 6 is a vertical sectional view of a conventional muffler.

That is, in the graph shown in FIG. 2 in which the engine r.p.m. is taken along the axis of abscissa and the noise level of exhaust gases is taken along the axis of ordinate, the curve "a" depicted by the solid line designates the muffling characteristic of the muffler according to the instant embodiment and the curve "b" depicted by the dot-dash-line designates the muffling characteristic of the conventional muffler shown in FIG. 6.

FIG. 3 shows the so called A-characteristic of the muffler of the instant embodiment wherein the curve "c" depicted by the solid line designates the muffling characteristic of the muffler according to the instant embodiment and the curve "d" depicted by the dot-dash-line designates the muffling characteristic of the conventional muffler.

The muffler of the above structure makes it possible to reduce the pressure resistance of exhaust gases since the stream of the exhaust gases branches off in the first expansion chamber 51 as shown by the arrows in FIG. 1.

Further, the muffling characteristic of the above type of muffler can be easily changed by varying the number or size of the throughholes drilled in the portion of the return pipe 59 passing through the resonator chamber 53.

It should be noted that although the return pipe 59 of the instant embodiment has been described as having a number of small throughholes at the portion passing through the resonator chamber 53, the present invention is not limited thereto and it is of course possible to dril a single large-diametered hole in that portion or to provide a louver hole instead for the throughhole.

Figure 4:
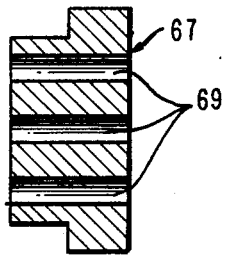
FIG. 4 is a vertical sectional view of a plug used with one embodiment (as a second invention) of a muffler according to the present invention.
Figure 5:
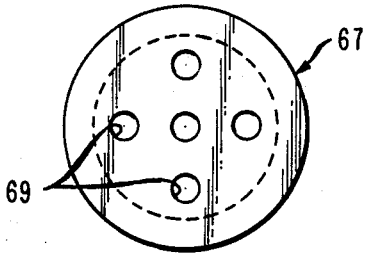
FIG. 5 is a side view of the muffler shown in FIG. 4.

FIGS. 4 and 5 show another embodiment (as a second invention) according to the present invention, especially a detail of a plug used in this embodiment. The plug designated by reference numeral 67 is provided with a plurality of small throughholes 69 in the axial direction. The muffler according to this embodiment is similar in structure to the muffler shown in FIG. 1 except that the plug 67 is provided with the throughholes 69 and the portion of the return pipe 59 passing through the resonator chamber 53 is not provided with throughholes like the throughholes 65 shown in FIG. 1.

The muffler according to this embodiment makes it posble to sharply improve the muffling efficiency over the conventional muffler throughout the entire operation of the engine in both high- and low-speed operation zones. At the same time, the muffling characteristic of this type of muffler can be easily changed by varying the number or diameter of the throughholes 69 drilled in the plug 67.

It should be noted that although the instant embodiment has been described with respect to the plug 67 provided with a plurality of small holes, the present invention is not always limited thereto and therefore, it is of course possible to drill a single large-diametered throughhole in the plug, for example.

Further, in the above two embodiments, the return pipe 59 or the plug 67 is provided with the throughholes 65 or 69 but the present invention is not always limited thereto and it is of course possible to drill throughholes in the return pipe and the plug.

We claim:

1. In a muffler including a first expansion chamber, a second expansion chamber, a resonator chamber, an inlet pipe having a first open end and a second open end and the first open end of the inlet pipe is inserted into the first expansion chamber so as to communicate with the first expansion chamber;

a resonator pipe inserted into said resonator chamber and extending substantially in coaxial relationship with the inlet pipe so as to establish communication between the first expansion chamber and the resonant chamber;

a return pipe disposed between the resonator chamber and the second expansion chamber and passing through the first expansion chamber for establishing communication between the first expansion chamber and the second expansion chamber; and an outlet pipe communicating with the second expansion chamber;

the improvement characterized in that said return pipe has a portion connecting an open end thereof partially extending into said resonator chamber, said open end being sealed with a plug and said extended portion in said resonator chamber and another portion of said return pipe passing through the first expansion chamber being provided with at least a throughhole.

2. In a muffler including a first expansion chamber, a second expansion chamber, a resonator chamber, an inlet pipe having a first open end and a second open end and wherein the first open end of the inlet pipe is inserted into the first expansion chamber so as to communicate with the first expansion chamber, a resonator pipe inserted into said resonator chamber and extending substantially in coaxial relationship with the inlet pipe so as to establish communication between the first expansion chamber and the resonant chamber, a return pipe disposed between the resonator chamber and the second expansion chamber and passing through the first expansion chamber for establishing communication between the first expansion chamber and the second expansion chamber and an outlet pipe communicating with the second expansion chamber, the improvement characterized in that said return pipe has a portion connecting an open end thereof said open end being sealed with a plug having a plurality of throughholes in an axial direction of the return pipe, and another portion of the return pipe passing through the first expansion chamber being provided with at least a throughhole.

3. A muffler including a first expansion chamber;

a second expansion chamber;

a resonator chamber;

an inlet pipe having a first open end and a second open end and wherein the first open end of the inlet pipe is inserted into the first expansion chamber so as to communicate with the first expansion chamber;

a resonator pipe inserted into said resonator chamber and extending substantially in coaxial relationship with the inlet pipe so as to establish communication between the first expansion chamber and the resonant chamber;

a return pipe disposed between the resonator chamber and the second expansion chamber and passing through the first expansion chamber for establishing communication between the first expansion chamber and the second expansion chamber; and an outlet pipe communicating with the second expansion chamber and wherein said return pipe has a portion connecting an open end thereof inserted into said resonator chamber, said open end being sealed with a plug and said inserted portion being provided with at least a throughhole.

4. The muffler according to claim 3 wherein the plug is provided with a plurality of throughholes in an axial direction of the return pipe.

5. The muffler according to claim 1, 2 or 3, wherein a portion of the return pipe is located within the second expansion chamber and provided with at least a throughhole.

* * * * *